US006805051B2

(12) United States Patent
Miwa et al.

(10) Patent No.: US 6,805,051 B2
(45) Date of Patent: Oct. 19, 2004

(54) LITHOGRAPHIC PRINTING PLATE SUPPORT AND METHOD OF MANUFACTURING THE SAME

(75) Inventors: Hideki Miwa, Shizouka-ken (JP); Teruyoshi Yasutake, Shizuoka-ken (JP); Atsushi Matsuura, Shizuoka-ken (JP); Akio Uesugi, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/418,217

(22) Filed: Apr. 18, 2003

(65) Prior Publication Data

US 2004/0045466 A1 Mar. 11, 2004

Related U.S. Application Data

(62) Division of application No. 09/876,996, filed on Jun. 11, 2001, now Pat. No. 6,575,094.

(30) Foreign Application Priority Data

Jun. 9, 2000 (JP) ..... 2000-173770
Jun. 9, 2000 (JP) ..... 2000-173771
Jun. 26, 2000 (JP) ..... 2000-191501

(51) Int. Cl.[7] ..... B41N 3/04
(52) U.S. Cl. ..... 101/458
(58) Field of Search ..... 101/453, 454, 101/458, 459, 463.1; 428/141, 195, 650, 687; 430/278.1; 451/36

(56) References Cited

U.S. PATENT DOCUMENTS

| | | | | |
|---|---|---|---|---|
| 4,976,198 | A | 12/1990 | Ohba et al. | |
| 5,432,046 | A | 7/1995 | Wanat et al. | |
| 5,550,002 | A | 8/1996 | Kojima et al. | |
| 5,728,503 | A | 3/1998 | Dhillon et al. | |
| 5,731,124 | A | 3/1998 | Jonckheere et al. | |
| 5,837,345 | A | 11/1998 | Nishino et al. | |
| 6,014,929 | A | 1/2000 | Teng | |
| 6,176,182 | B1 | 1/2001 | Nakayama et al. | |
| 6,232,037 | B1 | 5/2001 | Uesugi et al. | |
| 6,242,156 | B1 | 6/2001 | Teng | |
| 6,324,978 | B1 | 12/2001 | Kaulen et al. | |
| 6,475,630 | B1 * | 11/2002 | Uesugi et al. | 428/472 |

FOREIGN PATENT DOCUMENTS

| | | |
|---|---|---|
| EP | 0 835 764 A1 | 4/1998 |
| EP | 0 841 190 A1 | 5/1998 |
| EP | 0 979 738 A1 | 2/2000 |
| JP | 62-001586 A | 1/1987 |
| JP | 02-215599 A | 8/1990 |
| JP | 10-315651 A | 12/1998 |

* cited by examiner

*Primary Examiner*—Stephen R. Funk
(74) *Attorney, Agent, or Firm*—Sughrue Mion, PLLC

(57) ABSTRACT

A lithographic printing plate support is provided which becomes a support of a PS plate which has excellent ability to withstand repeated printing, and in which defects in appearance, such as dirtying and the like, do not occur. Also provided are a method of manufacturing the lithographic printing plate support and a PS plate which has such merits.

4 Claims, 3 Drawing Sheets

LITHOGRAPHIC PRINTING PLATE SUPPORT AND METHOD OF MANUFACTURING THE SAME

This is a divisional application based on Ser. No. 09/876,996 filed Jun. 11, 2001, and issued on Jun. 10, 2003 as U.S. Pat. No. 6,575,094, the disclosure of which is incorporated herein by reference.

BACKGROUND OF THE INVENTION

Field of the Invention

The present invention relates to a method of manufacturing a lithographic printing plate support, a lithographic printing plate support, and a PS plate. In particular, the present invention relates to a lithographic printing plate support which becomes the support of a PS plate having excellent printing performances and ability to withstand repeated printing, and to a manufacturing method which enables the lithographic printing plate support to be manufactured with high production stability, and to a PS plate having the above merits.

Description of the Related Art

Generally, a lithographic printing plate support is manufactured by the following processes being carried out successively. While an abrasive slurry, in which an abrasive is suspended in water, is supplied to the surface of an aluminum or aluminum alloy plate (hereinafter, "aluminum plate") or a web or the like, the surface is subjected to a mechanical surface roughening treatment in which mechanical abrading is carried out by a rotary brush or the like. Next, the lithographic printing plate support is subjected to an etching treatment by an alkali agent, an electrolytic surface roughening treatment, an anodizing treatment, and the like.

In the mechanical surface roughening treatment, generally, abrading is carried out by a roller-like brush or the like while the abrasive slurry, in which an abrasive in the form of particles is suspended in water or the like, is supplied.

However, conventionally, at the time of mechanical surface roughening, the surface of the aluminum plate or the like is rubbed by the bristles of the roller-like brush, and scratches of a length of about 1 mm are formed or the abrasive pierces the surface such that a large number of indentations are formed. Further, these scratches and indentations are not removed even by the etching treatment and the electrolytic surface roughening treatment and the like carried out thereafter, and remain on the surface.

In the aforementioned mechanical abrading, recovery and reuse of the abrasive slurry are widely carried out with the intent to conserve the abrasive slurry and keep the amount of generated waste water low. However, at the time of mechanical abrading, at least a portion of the abrasive particles within the abrasive slurry are ground and become finer particles. Accordingly, when the abrasive slurry is merely recovered and reused, the finely ground abrasive particles accumulate in the abrasive slurry, and the average particle diameter of the abrasive in the abrasive slurry gradually decreases. As a result, the average particle diameter of the abrasive particles becomes excessively small, and the quality of the lithographic printing plate support is unstable.

A printing plate, which is prepared from a PS plate in which a photosensitive layer is formed on such a lithographic printing plate support, has a poor ability to withstand repeated printing. Further, when printing is carried out by using this printing plate, ink adheres to the drum of the rubber roller of the printer and ink enters into the scratches caused by the abrasive piercing the printing plate, such that there is dirtying of the non-image portions of the printed sheet surface.

SUMMARY OF THE INVENTION

In view of the aforementioned, an object of the present invention is to provide a lithographic printing plate support which becomes the support of a PS plate which has an excellent ability to withstand repeated printing and in which defects in appearance, such as blanket roller dirtying, in which the rubber drum of an offset printer is dirtied, and spot dirtying of the printed sheet surface and the like, do not occur, and to provide a method for manufacturing the lithographic printing plate support, and a PS plate having the above merits.

One aspect of the present invention is a method of manufacturing a lithographic printing plate support comprising the step of: subjecting at least one surface of a lithographic printing plate support to a mechanical surface roughening treatment by rubbing by a rotary brush while abrasive particles are supplied, the abrasive particles being such that an average particle diameter thereof is 5 to 70 $\mu$m, a contained amount of particles having a particle diameter of 100 $\mu$m or more is 10 wt % or less, a contained amount of particles having a particle diameter of 500 $\mu$m or more is 1 wt % or less, and the contents of $SiO_2$ is 90 wt % or more in particles.

In accordance with the above-described manufacturing method, a lithographic printing plate support is obtained which becomes the support of a PS plate having excellent ability to withstand repeated printing, and with which defects in appearance on printed sheet surfaces do not arise even if a large number of sheets are printed.

The present invention is also a method of manufacturing a lithographic printing plate support wherein a diameter of brush bristles of the rotary brush is 0.15 to 1.35 mm, and an embedding density of the brush bristles is 30 to 5000 bristles/cm$^2$.

A PS plate, whose support is the lithographic printing plate support obtained by the above-described method of manufacturing, has the merits of having a particularly good ability to withstand repeated printing, and causing little dirtying of printed sheet surfaces.

The present invention is also a lithographic printing plate support, wherein at least one surface of the lithographic printing plate support is subjected to a mechanical surface roughening treatment by being rubbed by a rotary brush while abrasive particles are supplied, the abrasive particles being such that a particle diameter thereof is 5 to 70 $\mu$m, a contained amount of particles having a particle diameter of 100 $\mu$m or more is 10 wt % or less, a contained amount of particles having a particle diameter of 500 $\mu$m or more is 1 wt % or less, and the contents of $SiO_2$ is 90 wt % or more in particles.

By forming a photosensitive layer on the surface of the lithographic printing plate support which surface has been subjected to the mechanical surface roughening treatment, a PS plate can be manufactured which has an excellent ability to withstand repeated printing and with which defects in appearance on printed sheet surfaces do not arise even if a large number of sheets are printed.

The present invention is also a PS plate wherein the surface of the lithographic printing plate support, which surface has been subjected to the surface roughening treatment, is subjected to an anodizing treatment, and a photosensitive layer is formed on the surface.

This PS plate has an excellent ability to withstand repeated printing, and defects in appearance on printed sheet surfaces do not arise even if a large number of sheets are printed. Thus, the PS plate is particularly suited for offset printing for newspapers and magazines of which ability to withstand repeated printing and image quality of the printed sheet surfaces are strongly required.

Another aspect of the present invention is a lithographic printing plate support, wherein at a surface which is subjected to the surface roughening treatment and an anodizing treatment, a surface roughness Ra is from 0.3 to 1.0 $\mu$m, a maximum roughness Rmax is 10 $\mu$m or less, a number Pc of roughness protrusions is 15 to 35 protrusions per mm for protrusions having a protrusion height which is greater than a set value +0.3 $\mu$m and a indentation depth which is deeper than the set value −0.3 $\mu$m, and a number Pc of roughness protrusions is 7 to 25 protrusions per mm for protrusions having a protrusion height which is greater than the set value +0.6 $\mu$m and a indentation depth which is deeper than the set value −0.6 $\mu$m, and the number Pc of roughness protrusions is 2 to 18 protrusions per mm for protrusions having a protrusion height which is greater than the set value +1.0 $\mu$m and a indentation depth which is deeper than the set value −1.0 $\mu$m.

The surface of the lithographic printing plate support is formed to be uniformly rough. Accordingly, a PS plate, which has this lithographic printing plate support as the support thereof, has the advantages of having excellent ability to withstand repeated printing, water retaining ability, tone reproducibility, difficulty of dirtying the non-image portions, and water/ink balance, as well as a small dot gain.

The present invention is also a PS plate wherein a photosensitive layer is formed on the surface of the lithographic printing plate support which surface has been subjected to a surface roughening treatment and an anodizing treatment.

Because this PS plate has excellent adhesion between the lithographic printing plate support and the photosensitive layer, the ability to withstand repeated printing is high. Further, the water retaining ability, tone reproducibility, difficulty of dirtying the non-image portions, and water/ink balance are excellent, and the dot gain is small. Moreover, defects in appearance such as blanket roller dirtying and spot dirtying and the like do not occur.

Another aspect of the present invention is a method of manufacturing a lithographic printing plate support comprising: an abrasive slurry supplying step in which an abrasive slurry is supplied to at least one surface of a lithographic printing plate support; a mechanical abrading step in which a surface of the lithographic printing plate support at a side to which the abrasive slurry has been supplied is mechanically abraded; and an abrasive slurry waste liquid recovering step in which abrasive slurry waste liquid which is generated in the mechanical abrading step is recovered, and particles, whose average particle diameter is from ⅓ to 1/10 of an average particle diameter of abrasive particles contained in the abrasive slurry supplied in the abrasive slurry supplying step, are removed from the abrasive slurry waste liquid, and remaining slurry is returned to the abrasive slurry supplying step.

In this manufacturing method, in the abrasive slurry waste liquid recovering step, small diameter particles, which have an average particle diameter in a specific range, are removed, and the remaining slurry is used again. Thus, not only can the amount of abrasive slurry which is consumed be reduced, but also, the average particle diameter of the abrasive particles in the abrasive slurry does not become excessively large or excessively small. Accordingly, a PS plate, whose support is the lithographic printing plate support obtained by this manufacturing method, has excellent ability to withstand repeated printing. Further, when the PS plate is used in offset printing, there is little adhesion of printing ink to the blanket roller at the printer, and thus, it is difficult for so-called blanket roller dirtying to arise.

The present invention also is a method of manufacturing a lithographic printing plate support in which the average particle diameter of the abrasive in the abrasive slurry is 10 to 70 $\mu$m.

A PS plate, whose support is the lithographic printing plate support obtained by this manufacturing method, has, in particular, excellent ability to withstand repeated printing and it is difficult for blanket roller dirtying to occur.

The present invention is also a method of manufacturing a lithographic printing plate support, wherein in the abrasive slurry waste liquid recovering step, the particles, whose average particle diameter is from ⅓ to 1/10 of the average particle diameter of the abrasive particles contained in the abrasive slurry supplied in the abrasive slurry supplying step, are removed by classification by a cyclone.

A cyclone has no movable portions, and the pressure loss thereof is low as compared with that of an ordinary filter or the like. Accordingly, in this manufacturing method, little energy is required for the removal of the particles having an average particle diameter within the above range, and reliability is high.

The present invention is also a device for manufacturing a lithographic printing plate support, the device comprising: an abrasive slurry supplying device which supplies an abrasive slurry to a surface to be abraded of a lithographic printing plate support; a mechanical abrading device which mechanically abrades a surface of the lithographic printing plate support at a side to which the abrasive slurry has been supplied; and an abrasive slurry waste liquid recovering device which recovers abrasive slurry waste liquid which is generated in the mechanical abrading device, and which removes, from the abrasive slurry waste liquid, particles, whose average particle diameter is from ⅓ to 1/10 of an average particle diameter of abrasive particles contained in the abrasive slurry supplied by the abrasive slurry supplying device, and which returns remaining slurry to the abrasive slurry supplying device. The above-described manufacturing method can be particularly suitably implemented in this manufacturing device.

DETAILED DESCRIPTION OF THE PREFERRED EMBODIMENTS

1. Lithographic Printing Plate Support

Figure 1:
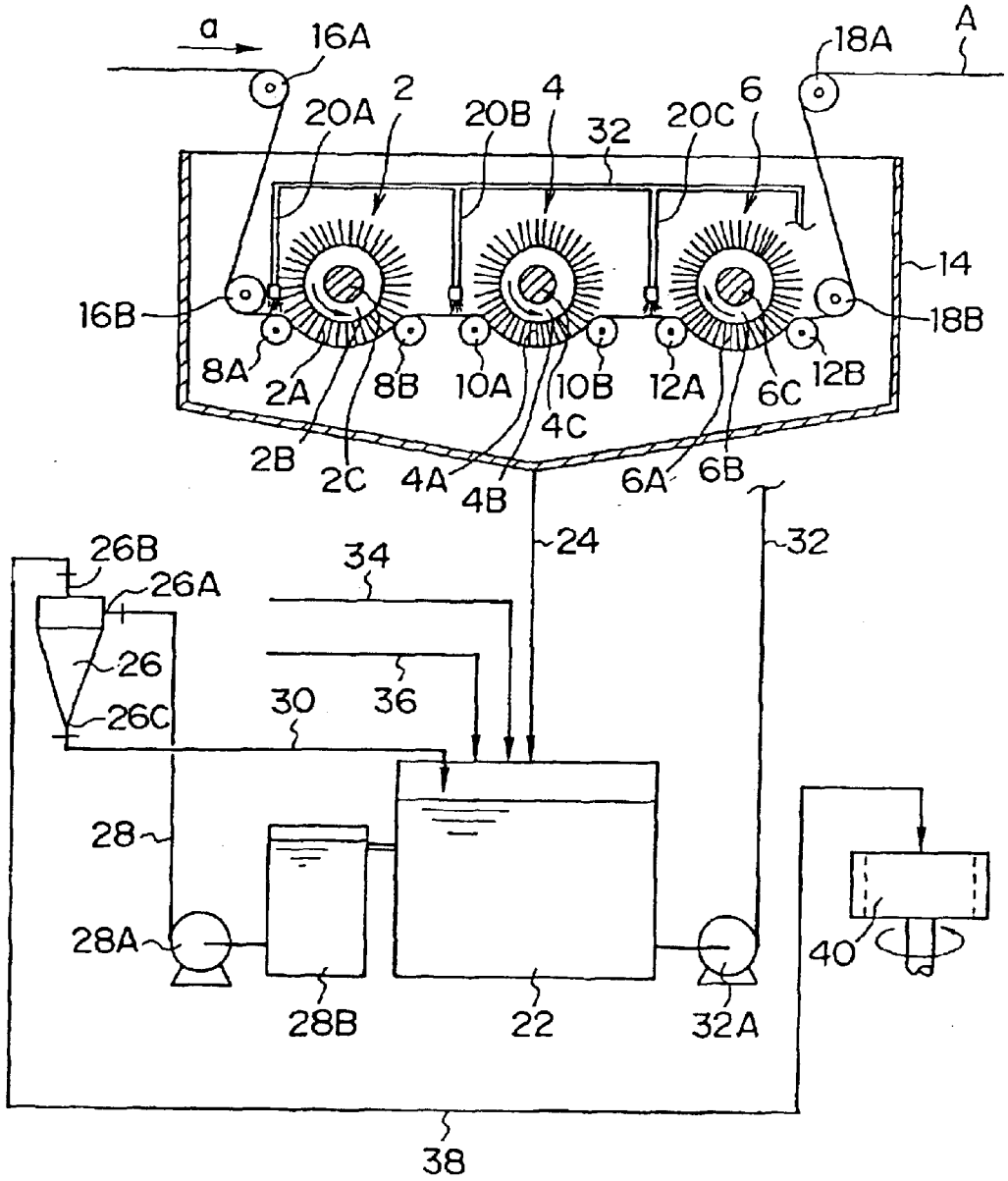
FIG. 1 is a schematic view illustrating an example of a abrading device used in manufacturing a lithographic printing plate support of the present invention, wherein A is an aluminum substrate, and 2A, 4A, 6A are brush bristles.

The surface roughness Ra of the surface, which has been subjected to a surface roughening treatment and an anodizing treatment, of the lithographic printing plate support of the present invention is preferably from 0.3 to 1.0 μm, and more preferably from 0.45 to 0.7 μm. The surface roughness Ra is a value represented by the following formula 1:

$$Ra = \left[\int_0^L |f(x)|\,dx\right]L \qquad \text{formula1}$$

wherein only a reference length L is extracted in the direction of an average line from a roughness curve of the surface at which the surface roughness is measured, and the direction of this average line of the extracted portion is along the X axis, and the direction of the vertical magnification is along the Y axis, and the roughness curve is expressed as y=f(x). The unit of the surface roughness Ra is usually μm. The reference length L is usually 3 mm, but is not limited to this length.

The maximum roughness Rmax in the aforementioned surface of the lithographic printing plate support of the present invention is 10 μm or less, and preferably 7 μm or less, and more preferably from 7 to 2 μm.

The maximum roughness Rmax is the maximum value of the distance between a protrusion peak line and a indentation bottom line in a portion of an evaluation length d. The evaluation length is usually 3 mm, but in the same way as the surface roughness Ra, is not limited to this length.

The number Pc of roughness protrusions is 15 to 35 protrusions per mm and preferably 23 to 30 protrusions per mm for protrusions having a protrusion height which is greater than a set value +0.3 μm and a indentation depth which is deeper than the set value −0.3 μm. The number Pc of roughness protrusions is 7 to 25 protrusions per mm and preferably 13 to 20 protrusions per mm for protrusions having a protrusion height which is greater than the set value +0.6 μm and a indentation depth which is deeper than the set value −0.6 μm. The number Pc of roughness protrusions is 2 to 18 protrusions per mm and preferably 5 to 10 protrusions per mm for protrusions having a protrusion height which is greater than the set value +1.0 μm and a indentation depth which is deeper than the set value −1.0 μm.

The set value of the number Pc of roughness protrusions is a height which is a reference level. Accordingly, the number Pc of roughness protrusions of protrusions having a protrusion height which is greater than the set value +0.3 μm and a indentation depth which is deeper than the set value −0.3 μm, is the number, per unit measured length, of the protrusions whose protrusion height is greater than the reference level +0.3 μm and whose indentation depth is deeper than the reference level −0.3 μm, and specifically, the number of such protrusions per measured length of 1 mm.

Similarly, the number Pc of roughness protrusions of protrusions having a protrusion height which is greater than the set value +0.6 μm and a indentation depth which is deeper than the set value −0.6 μm, is the number, per measured length of 1 mm, of the protrusions whose protrusion height is greater than the reference level +0.6 μm and whose indentation depth is deeper than the reference level −0.6 μm.

Further, the number Pc of roughness protrusions of protrusions having a protrusion height which is greater than the set value +1.0 μm and a indentation depth which is deeper than the set value −1.0 μm, is the number, per measured length of 1 mm, of the protrusions whose protrusion height is greater than the reference level +1.0 μm and whose indentation depth is deeper than the reference level −1.0 μm.

The surface roughness Ra, the maximum roughness Rmax, and the number Pc of roughness protrusions can all be determined on the basis of results of measuring the roughness of the surface of the lithographic printing plate by a usual surface roughness measuring device.

A lithographic printing plate support, whose surface roughness Ra, maximum roughness Rmax, and number Pc of roughness protrusions of the surface of the lithographic printing plate which surface has been subjected to a surface roughening treatment and an anodizing treatment fall within the aforementioned ranges, has a structure in which, at the aforementioned surface, relatively coarse-grained protrusion and indentation portions are formed uniformly, and at the inner side of these protrusion and indentation portions, more fine-grained, uniform protrusion and indentation portions are formed. Accordingly, a PS plate, in which a photosensitive layer is formed at the aforementioned surface of the lithographic printing plate, has good resistance to repeated printing due to the excellent adhesion between the photosensitive layer and the lithographic printing plate support. Further, the PS plate has a good water retaining property of the surface thereof, is difficult to be dirtied by printing ink, and has excellent tone reproducibility and water/ink balance. Thus, a clear and attractive printed sheet surface, i.e., a printed sheet surface having excellent image quality, can be obtained.

The lithographic printing plate support of the present invention may be a support formed by subjecting the surface of an aluminum substrate or the like to a surface roughening treatment and an anodizing treatment.

The material for the aluminum substrate may be selected from known aluminums and aluminum alloys.

2. Method of Manufacturing Lithographic Printing Plate Support

The lithographic printing plate support of the present invention can be manufactured by, for example, subjecting a metal substrate for a lithographic printing plate to a surface roughening treatment, and then to an anodizing treatment.

2-1 Surface Roughening

In the method of manufacturing of the present invention, in the surface roughening treatment, while abrasive particles, whose main component is $SiO_2$ particles and which have an average particle diameter and particle diameter distribution within specific ranges, are supplied, a mechanical surface roughening treatment of rubbing by a rotary brush is carried out on at least one surface of the metal substrate for a lithographic printing plate. Then, at least one of etching processing and an electrolytic surface roughening treatment can be carried out.

A. Mechanical Surface Roughening Treatment

In the mechanical surface roughening treatment, a brush-grain treatment, in which the surface of the metal substrate for a lithographic printing plate is rubbed by a rotary brush, can be carried out.

For example, a metal plate or a metal web (hereinafter, "metal web for a lithographic printing plate") which is usually used as the support for a PS plate or the like can be used as the metal substrate for a lithographic printing plate. For example, a plate or a sheet or the like which is formed from pure aluminum or an aluminum alloy (hereinafter, "aluminum or the like") may be used as the metal web for a lithographic printing plate. The metal substrate (aluminum substrate) for a lithographic printing plate may be in the form of a continuous sheet, or may be in the form of separate sheets which are of sizes corresponding to the PS plate and which are shipped as products.

The brush-grain treatment can be carried out while supplying abrasive particles between a rotary brush and the aluminum substrate.

The average particle diameter of the abrasive particles which are used in the brush-grain processing is preferably from 5 to 70 $\mu$m, and particularly preferably from 10 to 40 $\mu$m, and most preferably from 15 to 35 $\mu$m.

The amount of particles having a particle diameter of 100 $\mu$m or more included in the abrasive particles is preferably 10 wt % or less, and particularly preferably does not exceed 5 wt %. It is most preferable that such particles are contained in an amount not exceeding 2.5 wt % or are substantially not contained at all.

The amount of particles having a particle diameter of 500 $\mu$m or more included in the abrasive particles is preferably 1 wt % or less, and particularly preferably does not exceed 0.5 wt %. It is most preferable that such particles are contained in an amount not exceeding 0.2 wt % or are substantially not contained at all.

It is preferable that 90 wt % or more of the abrasive particles are $SiO_2$ particles. The abrasive particles may be only $SiO_2$ particles. Or, in addition to $SiO_2$ particles, scratch abrading agents such as aluminum, iron, clay, talc, iron oxide, chromium oxide, calcinated alumina or the like, as well as grinding agents such as diamond, emery, spinel, corundum, carborandum, boron carbide, and the like may be contained.

Due to the mechanical surface roughening treatment, mainly extremely large waves, which are the roughest-grained protrusion and indentation portions, and large waves, which are protrusion and indentation portions which are slightly more fine-grained than the extremely large waves, are formed in the surface of the lithographic printing plate support. The uniformity of the extremely large waves and the large waves is particularly strongly related to the magnitude of the dot gain, the tone reproducibility, the water retaining property of the surface, and the difficulty to be dirtied by printing ink of the PS plate. In the mechanical surface roughening treatment, if the above-described abrasive particles are used, the abrasive particles do not bite into the surface of the metal web for the lithographic printing plate and the surface is not gouged by abrasive particles having a large particle diameter. Thus, large scratches, which lead to so-called blanket roller dirtying, in which the rubber drum of an offset printer is dirtied, or to spot dirtying of the printed sheet surface or the like, are not formed in the surface of the lithographic printing plate support. In particular, a PS plate having a lithographic printing plate support, which is obtained by mechanical surface roughening treatment using the above-described abrasive particles and whose maximum roughness Rmax of the surface is 10 $\mu$m or less and whose surface roughness Ra is 0.3 to 1.0 $\mu$m, i.e., a PS plate having a lithographic printing plate support in which extremely large waves and large waves are formed uniformly, has a small dot gain, excellent tone reproducibility, an excellent water retaining property of the surface, and is difficult to be dirtied.

The abrasive particles can be used, for example, as a slurry or the like. The slurry may be a suspension or the like in which the abrasive particles are suspended in water in a concentration of about 5 to 70 wt %. Thickening agents, dispersants such as surfactants, preservatives, and the like can also be compounded into the suspension.

The mechanical surface roughening treatment can be carried out, for example, by using a abrading device such as that shown in FIG. 1.

As shown FIG. 1, this abrading device is provided with three roller-like brushes 2, 4, 6 which are disposed parallel and at the same height, and which abrade an aluminum substrate A which is conveyed in a constant direction a; support rollers 8A, 8B, 10A, 10B, 12A, 12B which are provided in parallel pairs for the roller-like brushes 2, 4, 6, and which support the aluminum substrate A from below; and a substantially parallelepiped housing 14 which accommodates the roller-like brushes 2, 4, 6 and the support rollers 8A, 8B, 10A, 10B, 12A, 12B, and through the interior of which the aluminum substrate A passes.

As shown in FIG. 1, the roller-like brushes 2, 4, 6 are provided with rotating shafts 2C, 4C, 6C which are parallel to one another; drums 2B, 4B, 6B which rotate around the rotating shafts 2C, 4C, 6C; and brush bristles 2A, 4A, 6A which are embedded in the side surfaces of the drums 2B, 4B, 6B and extend toward the outer side along the radial direction.

The brush bristles 2A, 4A, 6A preferably have a diameter of 0.15 to 1.35 mm and a length of 10 to 100 mm.

Examples of the brush bristles 2A, 4A, 6A are brush materials selected from synthetic resin bristles formed from a synthetic resin such as nylon, propylene, polyvinylchloride resin, or the like, animal hair such as cow hair, hog bristles, horse hair, or the like, and natural fibers such as wool or the like.

The brush bristles 2A, 4A, 6A are preferably embedded in the drums 2B, 4B, 6B at an embedding density of 30 to 5000 bristles per $cm^2$. The bristles may be embedded one-by-one, or plural bristles, e.g., bundles of 10 to 5000 bristles, may be embedded.

In the mechanical roughening treatment, it is preferable to use a roller-like brush, whose brush bristle diameter and embedded density fall within the above ranges, together with the above-described abrasive, because even more uniform extremely large waves and large waves can be formed in the surface of the aluminum substrate.

The support rollers 8A, 10A, 12A are provided so as to abut the tips of the brush bristles 2A, 4A, 6A of the roller-like brushes 2, 4, 6 at the conveying direction a upstream side (hereinafter, "upstream side"). The support rollers 8B, 10B, 12B are provided so as to abut the tips of the brush bristles 2A, 4A, 6A of the roller-like brushes 2, 4, 6 at the conveying direction a downstream side (hereinafter, "downstream side").

As shown in FIG. 1, at the surface to be abraded of the aluminum substrate, the roller-like brushes 2 and 4 rotate in the direction from the upstream side toward the downstream side. The roller-like brush 6 rotates at the surface to be abraded in the direction from the downstream side toward the upstream side, or in the direction opposite thereto. The rotational speed of the roller-like brushes 2, 4, 6 is preferably about 100 to 1000 rpm.

The support rollers 8A, 8B, 10A, 10B, 12A, 12B are all provided so as to rotate freely around their axes.

As shown in FIG. 1, a first upstream side guiding roller 16A, which guides the aluminum substrate A to the interior of the housing 14, is provided at the aluminum substrate A entry side above the housing 14. A first downstream side guiding roller 18A, which leads the aluminum substrate A to the exterior of the housing 14, is provided at the aluminum substrate A exit side. Within the housing 14, a second upstream side guiding roller 16B is provided parallel to the support rollers 4A and 4C at an upstream side in a vicinity of the support roller 4A. The second upstream side guiding roller 16B guides, between a roller-like brush 2 and the support rollers 2A and 2B, the aluminum substrate A which has been guided into the housing 14 by the first upstream side guiding roller 16A.

At the downstream side in a vicinity of the support roller 6B, a second downstream side guiding roller 18B is provided parallel to the support rollers 12A, 12B. The second downstream side guiding roller 18B guides, toward the first downstream side guiding roller 18A, the aluminum substrate A which has passed between the roller-like brushes 2, 4, 6 and the support rollers 8A, 8B, 10A, 10B, 12A, 12B.

Abrasive slurry supplying nozzles 20A, 20B, 20C, which supply the abrasive slurry, are provided at upstream sides in vicinities of the roller-like brushes 2, 4, 6, respectively.

As shown in FIG. 1, an abrasive slurry recovery tank 22, which recovers the abrasive slurry supplied from the abrasive slurry supplying nozzles 20A, 20B, 20C, is provided under the housing 14. The abrasive slurry recovery tank 22 communicates with the bottom portion of the housing 14 by an abrasive slurry return conduit 24.

The abrasive slurry recovery tank 22 is connected, via a slurry transfer conduit 28, to a cyclone 26 which separates the abrasive within the abrasive slurry into an abrasive of large diameter particles and an abrasive of small diameter particles. A pump 28A and an overflow tank 28B are disposed on the slurry transfer conduit 28. The pump 28A transfers the abrasive slurry within the recovery tank 22 to the cyclone 26. The overflow tank 28B is positioned between the pump 28A and the abrasive slurry recovery tank 22.

The cyclone 26 is formed in a substantially conical configuration whose diameter decreases toward the bottom thereof. A slurry introducing pipe 26A, through which the abrasive slurry is introduced, is provided at the side surface of the cyclone 26 in a vicinity of the top surface thereof. A slurry lead-out pipe 26B is provided at a central portion of the top surface of the cyclone 26. The slurry lead-out pipe 26B discharges the slurry, which contains mainly abrasive particles of a small particle diameter, among the slurry which is separated at the cyclone 26. A slurry lead-out pipe 26C is provided at the lower end portion of the cyclone 26. The slurry lead-out pipe 26C discharges the slurry, which contains mainly abrasive particles of a large particle diameter, among the slurry. The slurry introducing pipe 26A is connected to the slurry transfer pipe 28. The slurry lead-out pipe 26C communicates with the abrasive slurry recovery tank 22 by a slurry recovery conduit 30. The slurry lead-out pipe 26B is connected to a waste liquid line 38 which will be described later.

The abrasive slurry recovery tank 22 communicates with the abrasive slurry supplying nozzles 20A, 20B, 20C by an abrasive slurry supplying conduit 32 which is connected to a vicinity of a bottom portion of the abrasive slurry recovery tank 22. A pump 32A, which supplies the abrasive slurry to the abrasive slurry supplying nozzles 20A, 20B, 20C, is provided on the abrasive slurry conduit 32.

An abrasive replenishing conduit 34, which replenishes the abrasive, and a water replenishing conduit 36, which replenishes water, are provided at the abrasive slurry recovery tank 22.

A centrifugal separator 40, which separates the slurry discharged from the slurry lead-out pipe 26B into abrasive particles and water, is provided at the waste liquid line 38.

In the abrading device shown in FIG. 1, the aluminum substrate A, which has been conveyed toward the housing 14 along the conveying direction a, is guided between the roller-like brush 2 and the support roller 8A by the first upstream side guiding roller 16A and the second upstream side guiding roller 16B.

The aluminum substrate A, which is guided between the roller-like brush 2 and the support roller 8A, passes between the roller-like brush 2 and the support roller 8B, and then passes between the roller-like brush 4 and the support rollers 10A and 10B, and then passes between the roller-like brush 6 and the support rollers 12A and 12B. Then, the abrasive slurry which is stored in the abrasive slurry recovery tank 22 is supplied to the top surface of the aluminum substrate A from the abrasive slurry supplying nozzles 20A, 20B, 20C. Accordingly, due to the friction of the brush bristles 2A, 4A, 6A and the abrasive action of the abrasive particles in the abrasive slurry, the upper surface of the aluminum substrate A is mechanically surface roughened, such that extremely large waves and large waves are formed as described above.

The aluminum substrate A, which passes between the roller-like brush 6 and the support roller 12B, is lead to the exterior of the housing 14 by the second downstream side guiding roller 18B and the first downstream side guiding roller 18A.

The abrasive slurry, which is supplied from the abrasive slurry supplying nozzles 20A, 20B, 20C, flows down into the abrasive slurry recovery tank 22 through the abrasive slurry return conduit 24.

The abrasive slurry in the abrasive slurry recovery tank 22 is transferred through the slurry transfer conduit 28 by the pump 28A toward the cyclone 26.

In the cyclone 26, the abrasive slurry is introduced along the inner side wall surface, and flows toward the lower end portion while being rotated along the inner side wall surface. Accordingly, among the abrasive particles in the abrasive slurry, the particles having a large particle diameter collect in a vicinity of the inner side wall surface due to centrifugal force, whereas the particles with a small particle diameter gather in the central portion. The slurry is separated into a slurry mainly containing abrasive particles of relatively large particle diameters, and a slurry mainly containing abrasive particles of particle diameters much smaller than the average particle diameter of the abrasive particles. The former are lead out toward the slurry recovery conduit 30 from the slurry lead-out pipe 26C at the lower end portion of the cyclone 26. The latter slurry is lead out to the waste liquid line 38 from the slurry lead-out pipe 26B at the central portion of the top surface of the cyclone 26.

The slurry which is lead out toward the slurry recovery conduit 30 is returned to the abrasive slurry recovery tank 22.

The slurry which is lead out to the waste liquid line 38 is lead to the centrifugal separator 40 and separated into a substantially transparent liquid and abrasive particles. The former is discharged as waste liquid, whereas the latter is subjected to an appropriate treatment as industrial waste.

Figure 2:
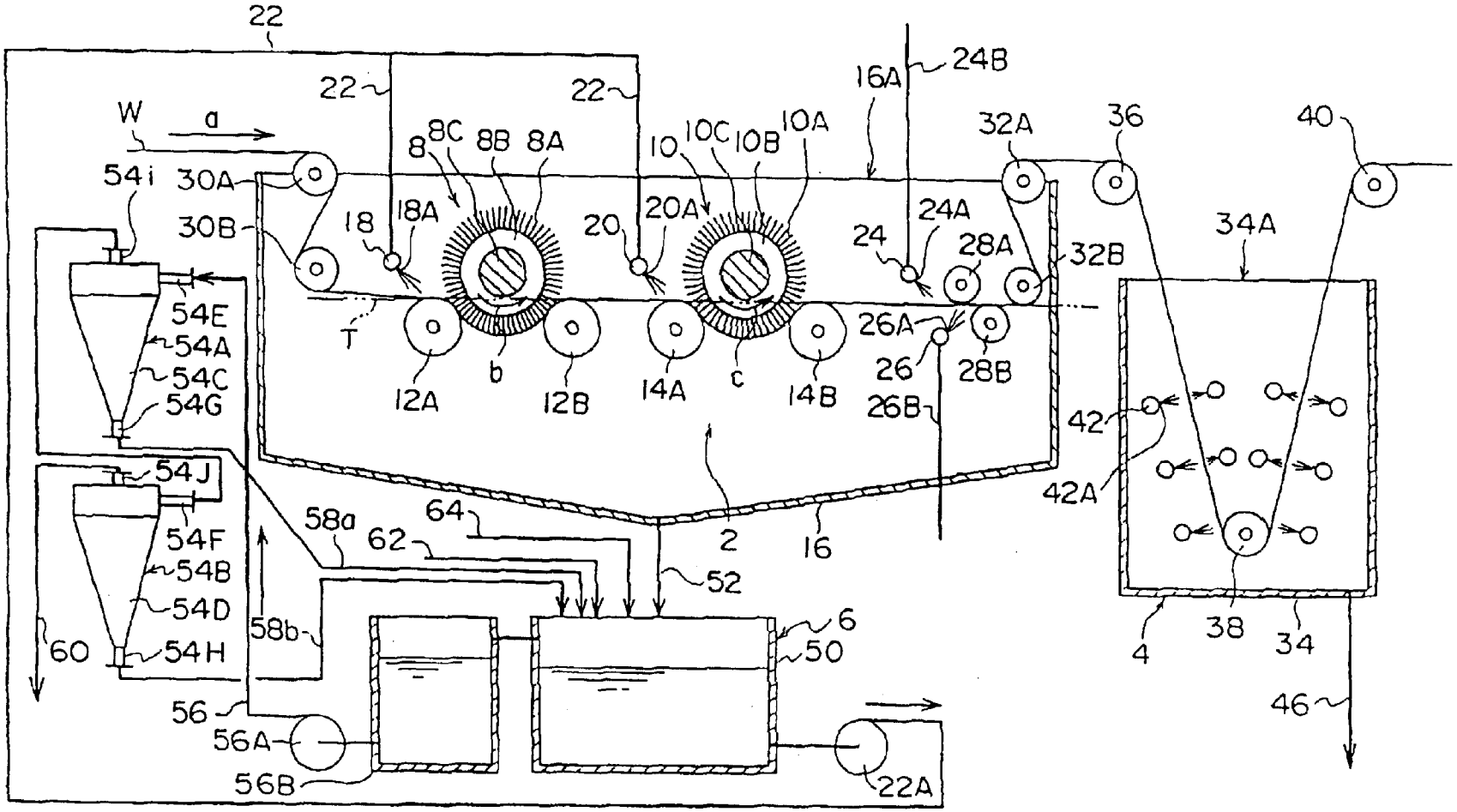
FIG. 2 is a schematic view which illustrates a basic structure of an example of a lithographic printing plate support manufacturing device of the present invention, wherein 2 is a brush-grain processing device, 6 is an abrasive slurry waste liquid recovering device, 8 is a rotary brush (mechanical abrading device), 10 is a rotary brush (mechanical abrading device), 18 is a first abrasive sprayer (abrasive slurry supplying device), 20 is a second abrasive sprayer (abrasive slurry supplying device) and 22 is an abrasive slurry supplying conduit (abrasive slurry supplying device).
Figure 3:
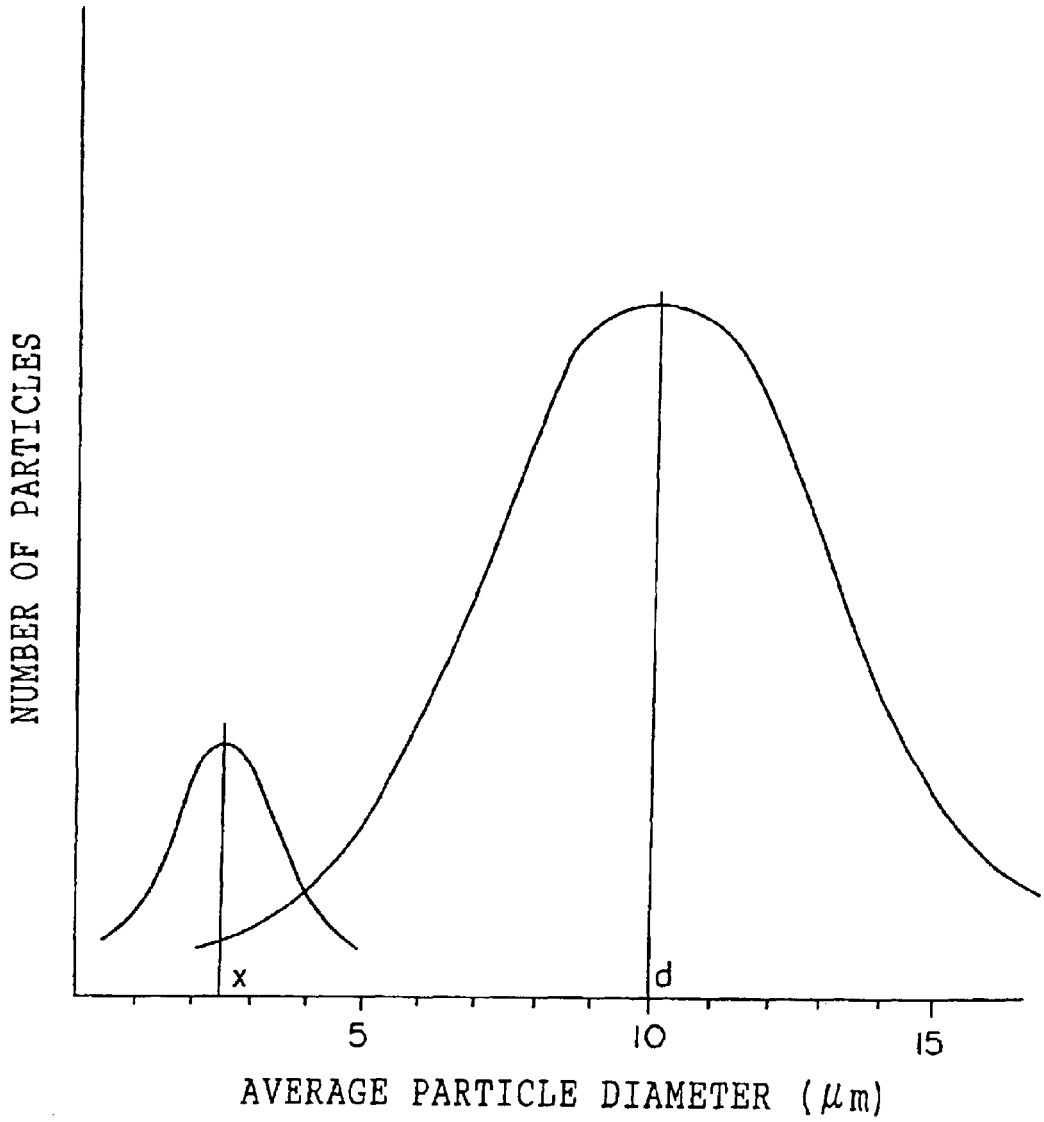
FIG. 3 is a particle diameter distribution graph showing a relationship between a particle diameter distribution of abrasive particles supplied in an abrasive slurry supplying step in the method of manufacturing a lithographic printing plate support of the present invention, and a particle diameter distribution of particles removed in the abrasive slurry waste liquid recovering step.

Other than the mechanical surface roughening processing of the lithographic printing plate support of the present invention, the lithographic printing plate support can be prepared, for example, by a manufacturing device equipped with a abrading device, such as shown in FIG. 2.

The manufacturing device shown in FIG. 2 is equipped with a brush-grain processing device 2 which, while supplying an abrasive slurry to the surface of an aluminum web W conveyed along a fixed direction a, carries out abrading processing by rotary brushes, i.e., brush-grain processing; a rinsing device 4 which rinses the aluminum web W which has been subjected to brush-grain processing at the brush-grain processing device 2; and an abrasive slurry waste liquid recovery device 6 which recovers the abrasive slurry generated at the brush-grain processing device 2, separates out the small diameter particles, and thereafter, returns the slurry to the brush-grain processing device 2.

As shown in FIG. 2, the brush-grain processing device 2 is provided with a rotary brush 8 which abrades the surface of the aluminum web W; a rotary brush 10 which is provided at the conveying direction a downstream side of the rotary brush 8, and similarly abrades the surface of the aluminum web W; support rollers 12A, 12B, 14A, 14B which are provided at the side of a conveying surface T, which is a path along which the aluminum web W is conveyed, which side is opposite the side at which the rotary brushes 8 and 10 are provided, and which support the aluminum web W from the underside thereof; and a housing 16 which accommodates the rotary brushes 8, 10 and the support rollers 12A, 12B, 14A, 14B, and which has an opening 16A at the top surface thereof. Hereinafter, the conveying direction a downstream side will be referred to as the "downstream side", and the conveying direction a upstream side will be referred to as the "upstream side". The aluminum web W is an example of the lithographic printing plate support of the present invention. The rotary brushes 8, 10 and the support rollers 12A, 12B, 14A, 14B correspond to the mechanical abrading device in the lithographic printing plate support manufacturing device relating to the present invention.

The rotary brushes 8, 10 are provided with rotating shafts 8C, 10C which are parallel to the conveying surface T and extend in the transverse direction of the conveying surface T; cylindrical drums 8B, 10B which rotate around the rotating shafts 8C, 10C; and brush bristles 8A, 10A which are embedded in the side surfaces of the drums 8B, 10B. The brush bristles 8A, 10A preferably have a diameter of 0.15 to 1.35 mm and a length of 20 to 100 mm. The brush bristles 8A, 10A are preferably embedded in the drums 8B, 10B at an embedding density of 30 to 5000 bristles per $cm^2$. Examples of the brush bristles 8A, 10A are synthetic resin bristles formed from a synthetic resin such as nylon, propylene, polyvinylchloride resin, or the like.

The rotary brushes 8, 10 are disposed such that a portion of the outer peripheral portion of each of the rotary brushes 8, 10 is positioned lower than the conveying surface T. As shown by arrows b and c in FIG. 2, the rotary brushes 8, 10 rotate, by an appropriate rotating means, in the same direction as the conveying direction a at a surface to be abraded of the aluminum web W.

The support roller 12A is provided at the upstream side of the rotary brush 8, and the support roller 12B is provided at the downstream side of the rotary brush 8. Similarly, the support roller 14A is provided at the upstream side of the rotary brush 10, and the support roller 14B is provided at the downstream side of the rotary brush 10.

As shown in FIG. 2, a first abrasive sprayer 18 is provided in a vicinity of the rotary brush 8, and a second abrasive sprayer 20 is provided in a vicinity of the rotary brush 10. The first abrasive sprayer 18 sprays the abrasive slurry toward the region between the rotary brush 8 and the aluminum web W from above the conveying surface T. The second abrasive sprayer 20 sprays the abrasive slurry toward the region between the rotary brush 10 and the aluminum web W from above the conveying surface T.

Both the first abrasive sprayer 18 and the second abrasive sprayer 20 are pipe-shaped, and extend parallel with respect to the conveying surface T along the transverse direction of the conveying surface T. A plurality of spray holes 18A, 20A are formed in a row along the longitudinal direction. The spray holes 18A, 20A are formed so as to spray the abrasive slurry at a downward angle toward the downstream side, i.e., toward the lower right in FIG. 2. One end of each of the first abrasive sprayer 18 and the second abrasive sprayer 20 is connected to the abrasive slurry supplying conduit 22 which supplies the abrasive slurry, and the other ends are closed. The first abrasive sprayer 18, the second abrasive sprayer 20, and the abrasive slurry supplying conduit 22 correspond to the abrasive slurry supplying device in the lithographic printing plate support manufacturing device relating to the present invention.

As shown in FIG. 2, at the furthest downstream side within the casing 16 are provided a preliminary rinsing sprayer 24 which is provided above the conveying surface T and sprays washing water onto the surface of the aluminum web W; a preliminary rinsing sprayer 26 which is provided below the conveying surface T and sprays washing water onto the reverse surface of the aluminum web W; and water squeezing rollers 28A, 28B which squeeze the water, which has been sprayed from the preliminary rinsing sprayers 24, 26, from the surface and the reverse surface of the aluminum web W.

Both of the preliminary rinsing sprayers 24, 26 are pipe-shaped, and extend parallel with respect to the conveying surface T along the transverse direction of the conveying surface T. A plurality of washing water spray holes 24A, 26A are formed along the longitudinal direction. The washing water spray holes 24A, 26A are formed so as to spray washing water toward the conveying surface T as shown in FIG. 2. Ones of ends of the preliminary rinsing sprayers 24, 26 are connected to water supply conduits 24B, 26B. The amount of washing water sprayed from the preliminary rinsing sprayer 24 is preferably 5 to 50 liters/minute, and particularly preferably 10 to 50 liters/minute, per 1 m width of the aluminum web W. On the other hand, the amount of washing water sprayed from the preliminary rinsing sprayer 26 is preferably 5 to 50 liters/minute, and particularly preferably 10 to 35 liters/minute, per 1 m width of the aluminum web W.

If the amount of washing water sprayed at a preliminary rinsing section 2C is within the above ranges, the abrasive slurry adhering to the aluminum web W is sufficiently washed away, and therefore, the amount of abrasive brought out into the rinsing device 4 can be made small. Further, the degree to which the washed-off abrasive slurry is diluted by the washing water is low. Thus, at the abrasive slurry waste liquid recovery device 6, the fluctuations in the concentration of the abrasive particles in the abrasive slurry due to the recovery of the abrasive slurry can be kept small.

As shown in FIG. 2, the water squeezing rollers 28A, 28B are positioned at the downstream sides of the preliminary rinsing sprayers 24, 26, and are provided so as to be freely rotatable so as to rotate while abutting the upper surface and lower surface of the aluminum web W, respectively.

Upstream side guiding rollers 30A, 30B are provided at the most upstream side of the interior of the housing 16 as shown in FIG. 2. The upstream side guiding rollers 30A, 30B guide the aluminum web W, which has been transported toward the housing 16, from the opening 16A to the region between the rotary brush 8 and the support rollers 12A, 12B. On the other hand, downstream side guiding rollers 32A, 32B are provided at the most downstream side of the interior of the housing 16. The downstream side guiding rollers 32A, 32B guide the aluminum web W, which has passed through the water squeezing rollers 28A, 28B, to the exterior of the housing 16.

The rinsing device 4 is provided downstream of the housing 16. The rinsing device 4 includes a housing 34 whose upper surface is open and through which the aluminum web W passes; an upstream side guiding roller 36 which guides the aluminum web W from an opening 34A of the housing 34 into the housing 34; a turn-around roller 38 which is provided in a vicinity of the bottom surface of the housing 34, and which guides the aluminum web W, which has been guided into the housing 34 by the upstream side guiding roller 36, upwardly at an angle toward the opening 34A; a downstream side guiding roller 40 which guides the aluminum web, which has passed through the interior of the housing 34, toward the downstream side of the rinsing device 4; and rinsing sprayers 42 which are pipe-shaped sprayers which spray washing water toward the both surfaces of the aluminum web W which passes through the interior of the housing 34.

As shown in FIG. 2, the washing sprayers 42 are disposed parallel with respect to the conveying path of the aluminum web W within the housing 34. A plurality of washing water spray holes 42A, which spray washing water toward the aluminum web W, are formed in a row along the longitudinal direction. The flow rate of washing water at the washing water sprayer 42 is usually 300 to 5000 liters/min per 1 m width of the aluminum web W, but is not limited to this range.

A waste water line 46, which discharges the waste water which has been generated in the rinsing process, is provided at the bottom portion of the housing 34. A pit (not shown), which precipitates and removes the solids in the waste water, is provided at the waste water line 46.

As shown in FIG. 2, the abrasive slurry waste liquid recovery device 6 is provided with a slurry circulating tank 50 which is positioned beneath the housing 16 and in which the abrasive slurry is stored; a conduit 52 which communicates the bottom portion of the housing 16 and the slurry circulating tank 50, and which leads, to the slurry circulating tank 50, abrasive slurry waste liquid such as the abrasive slurry supplied to the brush-grain processing device 2 and the abrasive slurry washed off by the washing water sprayed from the preliminary rinsing sprayers 24, 26; cyclones 54A, 54B which are aligned in series and which remove, from the abrasive slurry in the slurry circulating tank 50, particles (hereinafter, "small diameter particles") of a smaller average particle diameter than the abrasive particles contained in the abrasive slurry; a slurry return conduit 58 which returns to the slurry circulating tank 50 the abrasive slurry from which small diameter particles have been removed by the cyclones 54A, 54B; and the abrasive slurry supplying conduit 22 which supplies the abrasive slurry within the slurry circulating tank 50 to the first abrasive sprayer 18 and the second abrasive sprayer 20.

One end of the abrasive slurry supplying conduit 22 is provided in a vicinity of the bottom portion of the slurry circulating tank 50. A pump 22A, which feeds the abrasive slurry toward the first abrasive sprayer and the second abrasive sprayer, is provided on the abrasive slurry supplying conduit 22.

The cyclone 54A is provided with a cyclone main body 54C which is formed in a substantially conical shape whose diameter decreases toward the bottom thereof; a slurry introducing pipe 54E which is provided at the side surface of the cyclone main body 54C so as to extend from a vicinity of the top surface thereof in a tangential direction, and through which abrasive slurry is introduced from the slurry circulating tank 50; a slurry lead-out pipe 54G provided at the lower end portion of the cyclone main body 54C, and through which is led out the abrasive slurry from which the small diameter particles have been removed at the cyclone 54A; and a small diameter particle slurry discharge tube 54*i* which is provided at the upper surface of the cyclone main body 54C so as to extend upwardly from the central portion, and through which is discharged the small diameter particle slurry which has been classified at the cyclone 54A.

The cyclone 54B is provided with a cyclone main body 54D which is formed similarly to the cyclone main body 54C at the cyclone 54A; a slurry introducing pipe 54F which is formed similarly to the slurry introducing pipe 54E, and through which is introduced the abrasive slurry led out from the slurry lead-out pipe 54*i* at the cyclone 54A; a recovered slurry lead-out pipe 54H which, similarly to the recovered slurry lead-out pipe 54G, is provided at the lower end portion of the cyclone main body 54D, and through which is led out recovered slurry from which the small diameter particles have been removed at the cyclone 54B; and a small diameter particle slurry discharge tube 54J which, similarly to the small diameter particle slurry discharge tube 54*i*, is provided at the upper surface of the cyclone main body 54D, and through which is discharged the small diameter particle slurry which has been classified at the cyclone 54B.

The inner walls of the cyclone main bodies 54C, 54D are lined with an abrasion-resistant material such as an abrasion-resistant rubber, polyurethane resin, ceramic or the like, or are abrasion-resistant plated by chrome plating or the like.

The slurry introducing pipe 54E at the cyclone 54A communicates with a vicinity of the bottom portion of the slurry circulating tank 50 by a slurry introducing conduit 56. A pump 56A, which feeds the abrasive slurry within the slurry circulating tank 50 to the slurry introducing pipe 54, is disposed on the slurry introducing conduit 56, and an overflow tank 56B is disposed on the slurry introducing conduit 56 between the slurry circulating tank 50 and the pump 56A.

The recovered slurry introducing pipe 54G at the cyclone 54A and the recovered slurry introducing pipe 54H at the cyclone 54B communicate with the slurry circulating tank 50 via a slurry return conduit 58*a* and a slurry return conduit 58*b*, respectively.

An abrasive replenishing conduit 62, which replenishes the abrasive, and a water replenishing conduit 64, which replenishes water, are provided at the slurry circulating tank 50.

The small diameter particle slurry discharging pipe 54*i* at the cyclone 54A is connected to the slurry introducing pipe 54F at the cyclone 54B. The small diameter particle slurry discharging pipe 54J at the cyclone 54B is connected to a waste water line 60.

Operation of the manufacturing device shown in FIG. 2 will be described hereinafter.

The aluminum web W is conveyed in the direction of arrow a by a conveying device (not shown), and is guided into the brush-grain processing device 2 by the upstream side guiding rollers 30A, 30B.

The abrasive slurry within the slurry circulating tank 50 is supplied from the first abrasive sprayer 18 onto the surface of the aluminum web W which is guided within the brush-grain processing device 2.

In the present embodiment, the average particle diameter of the abrasive particles in the abrasive slurry is preferably from 10 to 70 $\mu$m, and is particularly preferably 25 to 50 $\mu$m. When the average particle diameter of the abrasive particles falls within this range, a lithographic printing plate support which becomes the support of a PS plate having particularly excellent printing properties and ability to withstand repeated printings, is obtained.

The aluminum web W, to which the abrasive slurry has been supplied from the first abrasive sprayer 18, passes between the rotary brush 8 and the support rollers 12A, 12B, and the surface thereof is mechanically abraded by the brush bristles 8A of the rotary brush 8.

Abrasive slurry, which is the same as that supplied from the first abrasive sprayer 18, is supplied from the second abrasive sprayer 20 onto the surface of the aluminum web W which has been mechanically abraded by the rotary brush 8. The aluminum web W, to which the abrasive slurry has been supplied from the second abrasive sprayer 20, passes between the rotary brush 10 and the support rollers 14A, 14B, and the surface thereof is mechanically abraded by the brush bristles 10A of the rotary brush 10.

The aluminum web W, whose surface has been abraded by the rotary brushes 8, 10, next passes between the preliminary rinsing sprayer 24 and the preliminary rinsing sprayer 26. Due to the washing water sprayed to the surface side of the aluminum web W from the preliminary rinsing sprayers 24, 26, the majority of the abrasive slurry which has adhered to the front surface and the reverse surface of the aluminum web W in the above-described mechanical abrading is washed off.

The aluminum web W next passes between the water squeezing rollers 28A, 28B, and the water droplets and the like adhering to the front surface and rear surface are squeezed out.

The aluminum web W, which has passed between the water squeezing rollers 28A, 28B, is guided to the exterior of the housing 16 by the downstream side guiding rollers 32A, 32B. Next, the aluminum web W is guided into the housing 34 at the rinsing device 4 by the upstream side guiding roller 36, and washing water is sprayed toward the front surface and the rear surface thereof from the rinsing sprayers 42. The rinsing process in the manufacturing method of the present invention is thereby carried out.

The aluminum web W, which has been rinsed in the rinsing device 4, is guided by the downstream side guiding roller 40 to post-processes, e.g., to an etching device (not shown) where an etching process is carried out.

The abrasive slurry waste liquid, which includes the abrasive slurry supplied from the first abrasive sprayer 18 and the second abrasive sprayer 20, the washing water from the preliminary rinsing sprayers 24, 26, and the abrasive slurry which has been rinsed off from the front surface and the reverse surface of the aluminum web W, is mixed in the bottom portion of the housing 16, and flows down into the slurry circulating tank 50 through the conduit 52. Thus, the abrasive slurry waste liquid is mixed in with the abrasive slurry in the slurry circulating tank 50.

The abrasive slurry waste liquid includes, as the small diameter particles, finely ground abrasive particles, which are abrasive particles which have been ground by mechanical abrading at the brush-grain processing device 2 such that the particle diameters thereof have been reduced, and abrasive dregs generated due to abrading, and the like. Thus, such small diameter particles are mixed in the abrasive slurry in the slurry circulating tank 50.

The abrasive slurry within the slurry circulating tank 50 is introduced from the slurry introducing pipe 54E into the cyclone 54A by the pump 56A via the overflow tank 56B.

As described above, the slurry introducing pipe 54E is provided in a tangential direction of the cyclone main body 54A. Thus, a flow which rotates around the axis of the cyclone main body 54A is generated in the abrasive slurry introduced into the cyclone main body 54A. Accordingly, the majority of the large diameter particles, such as the abrasive particles in the abrasive slurry and the like, move toward the wall surface of the cyclone main body 54A, and the majority of the small diameter particles gather in the central portion of the cyclone main body 54A. In this way, the majority of the small diameter particles can be removed from the abrasive slurry. The abrasive slurry, from which the majority of small diameter particles has been removed, is returned from the slurry lead-out pipe 54G through the slurry return conduit 58*a* to the slurry circulating tank 50.

The slurry which is discharged from the slurry discharge pipe 54*i* at the cyclone 54A is introduced into the slurry introducing pipe 54F of the cyclone 54B.

Among the above slurry, the abrasive slurry from which small diameter particles have been removed at the cyclone 54B is returned from the slurry lead-out pipe 54H through the slurry return pipe 58*b* to the slurry circulating tank 50.

The particles in the slurry which is separated at the cyclone 54B are almost all small diameter particles, and are discharged to the exterior of the system from the slurry discharge pipe 54J through the slurry discharge conduit 60.

Abrasive particles and water can be replenished to the abrasive circulating tank 50 from the abrasive replenishing conduit 62 and the water replenishing conduit 64 as needed, such that the abrasive concentration and particle-size distribution of the abrasive in the abrasive slurry within the abrasive circulating tank 50 are constant.

The average particle diameter of the small diameter particles separated at the cyclone 54B is ⅓ to 1/10 of the average particle diameter of the abrasive particles in the abrasive slurry. Here, the average particle diameter of the abrasive particles in the abrasive slurry is, for example, the average particle diameter of the abrasive slurry included in the abrasive slurry within the slurry circulating tank 50. The relation between the average particle diameter of the abrasive particles in the abrasive slurry and the average particle diameter of the small diameter particles is shown in FIG. 2. As can be seen from FIG. 2, in the same way as the abrasive particles within the abrasive slurry, the particle diameters of the small diameter particles as well are distributed along a normal curve. Given that the average particle diameter of the abrasive particles in the abrasive slurry is d, the average particle diameter x of the small diameter particles is d/3 to d/10.

The particle distribution of the small diameter particles can be determined by, for example, measuring, in accordance with a usual method, the particle diameter distribution of the particles within the small diameter particle slurry which is discharged from the slurry discharging pipe 54J. Examples of such a method include a screening method, a precipitation method, a light-scattering method, an optical diffraction method, and the like. The average particle diameter of the abrasive particles in the abrasive slurry in the slurry circulating tank 50 can be determined in the same way.

If the average particle diameter of the small diameter particles separated at the cyclone 54B is within the above range, less abrasive slurry is consumed, which is economical. Further, because the average particle diameter of the abrasive particles within the abrasive slurry does not become overly large, the surface roughness Ra of the lithographic printing plate support can be prevented from becoming excessively large. Accordingly, the lithographic printing plate support can be manufactured with high production stability. Further, a PS plate, whose support is the above-described lithographic printing plate support, has excellent printing properties and ability to withstand repeated printings.

In order to have the average particle diameter of the small diameter particles fall within the above range, the introduction flow rate and the introduction pressure of the abrasive slurry at the cyclones 54A, 54B can be regulated. Or, by regulating the particle diameter distribution of the abrasive which is replenished from the abrasive replenishing conduit 62, the average particle diameter of the abrasive in the abrasive slurry in the slurry circulating tank 50 can be regulated.

In the above-described lithographic printing plate support manufacturing device, two cyclones are disposed in series. However, a single cyclone may be used, or three or more cyclones may be disposed in series. Further, two or more cyclones may be disposed in parallel.

In the above-described manufacturing device, the finely ground abrasive particles and the abrasive dregs and the like in the abrasive slurry waste liquid are removed as small diameter particle slurry by the cyclone 54B, and the remaining slurry is recovered and utilized again as abrasive slurry. Thus, the amount of abrasive slurry which is consumed can be reduced. Moreover, the concentration and particle diameter distribution of the abrasive particles in the abrasive slurry can be maintained constant over a long period of time. Thus, lithographic printing plate supports, which become the supports of PS plates having excellent printing performances and excellent ability to withstand repeated printing, can be manufactured with high production stability.

Because neither of the cyclones 54A, 54B has movable portions, the structure of the abrasive slurry waste liquid recovery device 6 is simple, and the abrasive slurry waste liquid recovery device 6 seldom breaks down.

After the above-described mechanical surface roughening treatment, the aluminum substrate can be subjected to at least one of an etching treatment and an electrolytic surface roughening treatment. Further, after an electrolytic surface roughening treatment, the aluminum substrate may be subjected to a second etching treatment. Or, the aluminum substrate may undergo the following processings in the following order: a first etching treatment, a first death mat treatment, an electrolytic surface roughening treatment, a second etching treatment, and a second death mat treatment.

B. Etching Treatment

The etching treatment is carried out by using an alkali agent.

Examples of the alkali agent are solutions of a caustic alkali or an alkali metal salt. The concentration of the alkali agent in the solution is preferably 0.01 to 30 wt % and the temperature is preferably in a range of 20 to 90° C.

Examples of the caustic alkali include caustic soda, caustic potash, and the like.

Examples of the alkali metal salt include alkali metal silicates such as sodium metasilicate, sodium silicate, potassium metasilicate, potassium silicate, and the like; alkali metal carbonates such as sodium carbonate, potassium carbonate, and the like; alkali metal aluminates such as sodium aluminate, potassium aluminate, and the like; alkali metal aldonates such as sodium gluconate, potassium gluconate, and the like; and alkali metal hydrogenphosphates such as sodium secondary phosphate, potassium secondary phosphate, sodium tertiary phosphate, potassium tertiary phosphate, and the like. From the standpoints of a fast etching speed and low cost, a caustic alkali solution is particularly preferable as the alkali agent.

The amount of etching is preferably 0.1 to 20 g/m$^2$, and particularly preferably 1 to 15 g/m$^2$, and most preferably 2 to 10 g/m$^2$. The etching time is preferably from 5 seconds to 5 minutes.

If the etching amount and etching time are within the above ranges, the scraped-off dregs generated in the mechanical surface roughening treatment and the film remaining on the surface of the aluminum substrate and the like are dissolved and removed. However, the extremely large waves and large waves remain without being flattened, which is preferable.

The etching treatment can be carried out by using an etching tank usually used in etching treatment of an aluminum substrate. The etching tank may be either a batch type or a continuous type.

A first death mat treatment, which removes the residual dregs which remain on the surface of the aluminum substrate and which are not needed in the alkali solution, may be carried out between the etching treatment and the subsequent electrolytic surface roughening treatment. The first death mat treatment may be carried out by, for example, rinsing the aluminum substrate which has been subjected to the etching treatment, and then processing the aluminum substrate with a strong acid such as nitric acid, phosphoric acid, sulfuric acid, chromic acid, or the like, or a mixture thereof.

C. Electrolytic Surface Roughening Treatment

In the electrolytic surface roughening treatment, the aluminum substrate which has been etched in the above-described chemical etching step is, for example, alternating current electrolyzed by application of an alternating current to an acidic electrolytic solution.

An example of the acidic electrolytic solution is an electrolytic solution containing at least one of sulfuric acid, hydrochloric acid, and nitric acid. The concentration of the sulfuric acid, hydrochloric acid, and nitric acid in the acidic electrolytic solution can be suitably determined in accordance with the conditions of the electrolysis or the like, but is preferably a total of 0.3 to 15 wt %. The acidic electrolytic solution may also contain as needed an organic acid such as oxalic acid, acetic acid, citric acid, tartaric acid, lactic acid or the like; phosphoric acid, chromic acid, nitrates, chlorides, amines, and aldehydes. The acidic electrolytic solution may include aluminum ions, but the content of aluminum ions is preferably 50 g/liter or less. The temperature of the acidic electrolytic solution can also be set appropriately in accordance with the conditions of electrolysis or the like, but is preferably 30 to 80° C.

The frequency of the alternating current applied to the aluminum substrate is preferably 0.1 to 100 Hz. The voltage is preferably 10 to 50 V, with the anode-time voltage as a reference. The cathode-time voltage may be the same as the anode-time voltage, or may be less than the anode-time voltage.

The current density is preferably 5 to 100 A/dm$^2$, and the anode quantity of electricity is preferably 150 to 600 coulomb/dm$^2$.

The alternating current may be a sinusoidal wave current, or may be a rectangular wave current. Or, the alternating current may be the trapezoidal wave current disclosed in Japanese Patent Application Laid-Open (JP-A) No. 52-58602.

A batch type or a continuous type alternating current electrolytic tank may be used in the alternating current electrolytic treatment.

Due to the electrolytic surface roughening treatment, honeycombs, which are protrusion and indentation portions having a finer grain than the large waves, and micropores, which are protrusion and indentation portions having a finer grain than the honeycombs, are mainly formed. The honeycombs and the micropores are related mainly to the adherence between the photosensitive layer and the support in the PS plate, the water retaining property, the difficulty of being dirtied, the water/ink balance, the wear resistance, and the like. By carrying out electrolytic surface roughening under the above-described conditions, the number Pc of roughness protrusions falls within the range prescribed in claim 1 of the present application, i.e., a lithographic printing plate support in which honeycombs and micropores are uniformly formed can be obtained. Accordingly, a PS plate using this lithographic printing plate support as a support has a small dot gain, excellent tone reproducibility, excellent water retaining property of the surface, and is difficult to dirty, and in addition, has excellent ability to withstand repeated printing, water/ink balance, and wear resistance.

After the electrolytic surface roughening treatment, a second etching processing can be carried out.

The second etching processing can be carried out in an alkali solution having a pH of 10 or more. A specific example of the alkali solution is a solution containing the same type of alkali agent as that described above in connection with the previously described etching treatment. The concentration of the alkali agent in the alkali solution is the same as that mentioned above in connection with the previously described etching treatment. The temperature of the alkali solution is preferably from 25 to 60° C. The amount of etching is preferably from 0.1 to 5 g/m$^2$. The etching time can be set appropriately in accordance with the etching amount, the composition of the alkali solution, the temperature and the like, and, for example, a range of 1 to 10 seconds is preferable.

The aluminum substrate after this etching treatment is carried out may be subjected to a second death mat treatment by being immersed in a sulfuric acid aqueous solution of a temperature of 25 to 65° C. and having a sulfuric acid concentration of 5 to 40 wt %.

2-2 Anodizing Treatment

In the anodizing treatment, the aluminum substrate which has been subjected to the above-described surface roughening treatments is subjected to an anodizing treatment in accordance with a known method.

In the anodizing treatment, a direct current or a pulsating current is applied to the aluminum substrate in an electrolytic solution containing at least one of, for example, sulfuric acid, phosphoric acid, oxalic acid, chromic acid, and amidosulfonic acid.

Other than the aforementioned electrolytic solution, an example of the electrolytic solution used in the anodizing treatment is a solution which contains aluminum ions and at least one of sulfuric acid, phosphoric acid, oxalic acid, chromic acid, and amidosulfonic acid.

The concentration of the electrolytes in the electrolytic solution is preferably 1 to 80 wt %, and the temperature is preferably 5 to 70° C.

The anodizing treatment is preferably carried out such that the amount of the anodized film is 0.1 to 10 g/m$^2$. The current density is preferably 0.5 to 60 A/dm$^2$, and the voltage is preferably 1 to 100 V. The electrolyzing time is preferably 1 second to 5 minutes.

At the lithographic printing plate support, which has been subjected to anodizing treatment such that the amount of the anodized film falls in the above range, an anodized film having sufficient thickness and hardness is formed uniformly at the surface. Thus, a PS plate using this lithographic printing plate support as a support has excellent wear resistance of the non-image portions.

3. PS Plate

The PS plate of the present invention can be manufactured by forming a photosensitive layer on the surface of the above-described lithographic printing plate support, which surface has been subjected to a surface roughening treatment and on which surface an anodized film has been formed.

The photosensitive layer can be formed by applying a photosensitive resin solution, which contains a photosensitive resin, on the aforementioned surface of the lithographic printing plate support, and drying the applied solution in a dark place.

Examples of the photosensitive resin are a positive type photosensitive resin, which dissolves in a developing solution when light is applied thereto, and a negative type photosensitive resin which does not dissolve in a developing solution when light is applied thereto.

Examples of the positive type photosensitive resin are combinations of a diazide compound such as a quinonediazide compound or a naphthoquinonediazide compound, and a phenol resin such as phenol novalak resin or cresol novalak resin, or the like.

Examples of the negative type photosensitive resin are combinations of a diazo compound such as a diazo resin (e.g., a condensation product of an aromatic diazonium salt and an aldehyde such as formaldehyde), and a binder such as (meth)acrylate resin, polyamide resin, polyurethane, or the like; combinations of a vinyl polymer such as (meth) acrylate resin or polystyrene resin, and a vinyl monomer such as (meth)acrylic ester or styrene, and a photopolymerization initiator such as a benzoin derivative, a benzophenon derivative, or a thioxanthone derivative; and the like.

An example of the solution in the photosensitive resin solution is a solution which dissolves the photosensitive resin and which is volatile to a certain extent at room temperature. Specific examples include alcohol solvents, ketone solvents, ester solvents, ether solvents, glycol ether solvents, amide solvents and carbonate solvents.

Examples of the alcohol solvent are ethanol, propanol, butanol, and the like. Examples of the ketone solvent are acetone, methylethyl ketone, methylpropyl ketone, methylisopropyl ketone, diethyl ketone, and the like. Examples of the ester solvent include ethyl acetate, propyl acetate, methyl formate, ethyl formate, and the like. Examples of the ether solvent include tetrahydrofuran, dioxane, and the like. Examples of the glycol ether solvent include ethyl cellosolve, methyl cellosolve, butyl cellosolve, and the like. Examples of the amide solvent include dimethylformamide, dimethylacetoamide, and the like. Examples of the carbonate solvent include ethylene carbonate, propylene carbonate, diethyl carbonate, dibutyl carbonate, and the like.

Any of various coloring agents can be compounded in the photosensitive resin solution. Other than usual dyes, an exposure color forming dye which forms color upon exposure, and an exposure decoloring dye which become almost achromatic or completely achromatic upon exposure, can be used as the coloring agent. Examples of the exposure color forming dye include leuco dyes and the like. Examples of the exposure decoloring dye include triphenylmethane dyes, diphenylmethane dyes, oxazine dyes, xanthene dyes, iminonaphthoquinone dyes, azomethine dyes, anthraquinone dyes, and the like.

The PS plate of the present invention is prepared in accordance with the following processes.

First, as needed, the lithographic printing plate support is immersed in an aqueous solution of an alkali metal silicate, such as sodium silicate or potassium silicate or the like, to subject the surface thereof to a hydrophilizing treatment, as disclosed in U.S. Pat. Nos. 2,714,066 and 3,181,461. Or, if needed, a hydrophilic undercoat layer is formed at the lithographic printing plate support by applying thereon a hydrophilic compound having an $NH_2$ group, a —COOH group and a sulfone group, or by applying thereon a copolymer of a vinyl monomer which contains a sulfonic acid group such as p-styrene sulfonic acid which has a sulfonic acid group and a usual vinyl monomer such as acrylester (meth)acrylate or the like, as disclosed in JP-A Nos. 59-101651 and 60-149491.

Next, as described above, a photosensitive resin solution is applied onto the surface of the lithographic printing plate support which surface has been subjected to a surface roughening treatment and on which surface an anodized film is formed, and the applied solution is dried in a dark place such that a photosensitive layer is formed.

Examples of the method for applying the photosensitive resin solution include conventionally known methods such as a rotary coating method, a wire bar method, a dip coating method, an air knife coating method, a roller coating method, a plate coating method, and the like.

After the PS plate has been cut into an appropriate size as needed, exposure and development are carried out so as to form a printing plate. Exposure and development can be carried out in accordance with the same processes as used with conventionally known PS plates.

EXAMPLES

Hereinafter, the present invention will be specifically described by using Examples.

1. Preparation of Lithographic Printing Plate Support

Examples 1 Through 6, Comparative Examples 1 Through 8

1-1 Surface Roughening Treatment

A. Mechanical Surface Roughening Treatment

One surface of an aluminum substrate (an aluminum plate of a thickness of 0.3 mm) was subjected to a mechanical surface roughening treatment by using the abrading device shown in FIG. 1. A No. 8 nylon brush was used as the roller-like brush. The No. 8 nylon brush had an outer diameter of 600 mm, a brush bristle diameter of 0.5 mm, a brush bristle length of 50 mm, and a bristle embedding density of 400 bristles/cm$^2$. The abrading pressure was 0.5 A/100 mm, and the circumferential speed of the roller-like brush was 470 m/min.

At the time of the mechanical surface roughening treatment, in Examples 1 through 3 and Comparative Examples 1 through 5, particles, whose main component was $SiO_2$, which had an average particle diameter of 20$\mu$, in which the ratio of particles having a particle diameter of 100 $\mu$m or more was 2 wt %, and in which the ratio of particles having a particle diameter of 500 $\mu$m or more was 0 wt %, were used as the abrasive particles.

In Examples 4 through 6, abrasive particles were used whose main component was $SiO_2$ and whose average particle diameter and ratios of particles having a particle diameter of 100 $\mu$m or more and particles having a particle diameter of 500 $\mu$m or more were as per Table 1. In Comparative Examples 6 through 8, abrasive particles were used whose main part was $SiO_2$ and whose average particle diameter and ratios of particles having a particle diameter of 100 $\mu$m or more and particles having a particle diameter of 500 microns or more were as per Table 2.

An abrasive slurry, in which the abrasive particles were suspended in water in a ratio of 400 g/liter, was supplied onto the surface to be abraded of the aluminum plate from abrasive spray nozzles in a ratio of 200 liters/min for each spray nozzle. The conveying speed of the aluminum substrate was 30 m/min.

B. Etching Treatment

The aluminum substrate, which had been subjected to the mechanical surface roughening treatment, was made to pass through, at the aforementioned feeding speed, a continuous type etching tank in which was stored a caustic soda solution of a concentration of 10 wt % and a liquid temperature of 60° C., and etching treatment was carried out such that the etching amount was 10 g/m$^2$.

The aluminum substrate after etching processing was rinsed by being made to pass through a water tank, and was then made to pass through a continuous type death mat processing tank in which was stored a sulfuric acid aqueous solution of a concentration of 30 wt % and a liquid temperature of 60° C., such that the first death mat treatment was carried out.

C. Electrolytic Surface Roughening Treatment

A dilute nitric acid of a concentration of 2 wt % and a liquid temperature of 40° C. was used as the acidic electrolytic solution. Electrolytic surface roughening treatment was carried out by, while the aluminum substrate after the death mat treatment was made to continuously pass through the acidic electrolytic solution, the aluminum substrate being subjected to alternating current electrolysis by application of an alternating current of a frequency of 60 Hz, a current density of 20 A/dm$^2$, an anode quantity of electricity of 200 coulomb/cm$^2$, and a voltage of 20 V.

The aluminum substrate which had been subjected to the electrolytic surface roughening treatment was made to pass continuously through a caustic soda solution of a concentration of 10 wt % and a liquid temperature of 35° C. such that the amount of etching was 1.5 g/m$^2$, and the second etching treatment was thereby carried out. The aluminum substrate which had been subjected to the second etching treatment was rinsed, and was passed continuously through a dilute sulfuric acid of a concentration of 30 wt % and a liquid temperature of 60° C., such that the second death mat treatment was carried out.

1-2 Anodizing Treatment

The aluminum substrate after the surface roughening treatments was immersed continuously in a dilute sulfuric acid solution of a concentration of 10 wt % and a liquid temperature of 30° C. A DC current of 40 V was applied such that the current density was 10 A/dm$^2$. Anodizing treatment was carried out such that the amount of the anodized film was 2 g/m$^2$, and the lithographic printing plate support was prepared.

For Examples 1 through 3 and Comparative Examples 1 through 5, the surface roughness of the surface, of the lithographic printing plate support prepared in accordance with the above-described processes which surface had been subjected to surface roughening treatment and anodizing treatment, was measured by using a surface roughness meter (manufactured by Tokyo Seimitsu Co., Ltd.; trade name: SURFCOM 470570A; stylus: 2 $\mu$mR). From these results, the surface roughness Ra, the maximum roughness Rmax, the number Pc of roughness protrusions of protrusions having a protrusion height which was greater than the set value +0.3 $\mu$m and a indentation depth which was deeper than the set value −0.3 $\mu$m, the number Pc of roughness protrusions of protrusions having a protrusion height which was greater than the set value +0.6 $\mu$m and a indentation depth which was deeper than the set value −0.6 $\mu$m, and the number Pc of roughness protrusions of protrusions having a protrusion height which was greater than the set value +1.0 $\mu$m and a indentation depth which was deeper than the set value −1.0 $\mu$m, were determined. The results are shown in Table 1.

2. Preparation of PS Plate

The above-described lithographic printing plate support was immersed for 30 seconds in a sodium silicate solution of a concentration of 3 wt % and a liquid temperature of 70° C., such that the surface was made hydrophilic.

Next, a photosensitive resin solution having the following composition was applied in a coating amount of 1.5 g/m$^2$ such that a photosensitive layer was formed.

(a) an ester compound of 1,2-diazonaphthoquinone-5-sulfonylchloride and pyrogallol—acetone resin (recited in Example 1 of U.S. Pat. No. 3,635,709): 0.8 g
(b) novalak resin I represented by following structural formula I: 1.5 g
(c) novalak resin II represented by following structural formula II: 0.2 g
(d) novalak resin III represented by following structural formula III: 0.4 g
(e) 2-normal octylphenol—formaledehyde resin (recited in U.S. Pat. No. 4,123,279): 0.02 g
(f) naphthoquinone-1,2-diazide-4-sulfonic chloride: 0.01 g
(g) tetrahydro phthalic anyhdride: 0.02 g
(h) benzoic acid: 0.02 g
(i) pyrogallol: 0.05 g
(j) 4-[p-N,N-bis(ethoxycarbonylmethyl)aminophenyl]-2,6-bis(trichloromethyl)-S-triazine: 0.07 g
(k) a dye in which the counter anion of Victoria Pure Blue (manufactured by Hodogaya Chemical Co., Ltd.) was replaced by 1-naphthalenesulfonic acid: 0.045 g
(l) fluorine based surfactant (trade name: F176 PF manufactured by Dainippon Ink & Chemicals, Inc.): 0.01 g
(m) methylethyl ketone: 15 g
(n) 1-methoxy-2-propanol: 10 g Structural Formula I

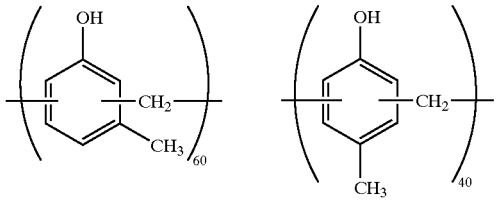

Mw = 8000

Structural Formula II

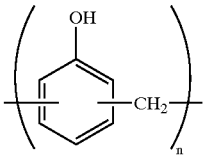

Mw = 15000

Structural Formula III

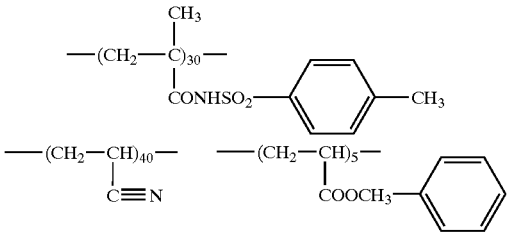

-continued

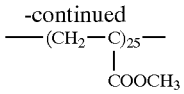

Mw = 50000

3. Evaluation of Printing Characteristics

The above-described PS plate was exposed for one minute by a metal halide lamp of 3 kW from a distance of 1 m.

The exposed PS plate was developed at 30° C. for 12 seconds by a PS processor (trade name: 900 VR) manufactured by Fuji Photo Film Co., Ltd., by using developing solution A and developing solution B having the following compositions.

Composition of Developing Solution A (a) sorbitol: 5.1 parts by weight
(b) sodium hydroxide: 1.1 parts by weight
(c) triethanolamine—ethyleneoxide additive (30 mol): 0.03 parts by weight
(d) water: 93.8 parts by weight Composition of Developing Solution B (a) sodium silicate aqueous solution whose [$SiO_2/Na_2O$] mol ratio was 1.2 and which contained $SiO_2$ in an amount of 1.4 wt %
(b) ethylenediamine—ethyleneoxide additive (30 mol): 0.03 parts by weight The ability to withstand repeated printing and the ease of dirtying of the PS plate which was processed as described above were evaluated in accordance with the following processes. The results are shown in Tables 1 and 2.

Ability to Withstand Repeated Printing

Printing was carried out by using a printer (trade name: LITHRONE 26, manufactured by Komori Insatsuki KK), and the ability to withstand repeated printing was evaluated by the number of sheets until normal printing could no longer be carried out. The higher the number of sheets, the better the ability to withstand repeated printing.

Ease of Dirtying

After 1000 sheets were printed by using a printer (trade name: Daiya 1F-2 manufactured by Mitsubishi Heavy Industries, Ltd.), printing was stopped and the PS plate was removed. The PS plate which was removed from the printer was left to stand for 30 minutes. Thereafter, the PS plate was again set at the printer, and 100 sheets were printed. The dirtying of the rubber roller drum in the printer at this time (blanket roller dirtying), and the dirtying of the printed sheet surface (spot dirtying) were observed. The results are shown in Table 1. In Table 1, "0.3— 0.3", "0.6—0.6", "1.0—1.0" respectively mean the protrusions having a protrusion height which is greater than the set value +0.3 $\mu$m and a indentation depth which is deeper than the set value −0.3 $\mu$m, the protrusions having a protrusion height which is greater than the set value +0.6 $\mu$m and a indentation depth which is deeper than the set value −0.6 $\mu$m, and the protrusions having a protrusion height which is greater than the set value +1.0 $\mu$m and a indentation depth which is deeper than the set value −1.0 $\mu$m.

TABLE 1

| | Surface Roughness | | | | | Printing Performance | | | |
|---|---|---|---|---|---|---|---|---|---|
| | | | Pc | | | | | | |
| | Ra | Rmax | 0.3–0.3 (protrusions per mm) | 0.6–0.6 (protrusions per mm) | 0.1–0.1 (protrusions per mm) | Ability to Withstand Repeated Printing | Blanket roller dirtying | Spot Dirtying | Surface Quality |
| Example 1 | 0.55 | 6.2 | 27 | 16 | 8 | 100 | ○ | ○ | ○ |
| Example 2 | 0.63 | 7.7 | 34 | 23 | 15 | 100 | ○ | ○Δ | ○ |
| Example 3 | 0.54 | 6.0 | 12 | 8 | 4 | 100 | ○ | ○ | ○ |
| Comp. Ex. 1 | 1.2 | 12.1 | 26 | 22 | 20 | 80 | X | X | Δ |
| Comp. Ex. 2 | 0.78 | 11.2 | 23 | 18 | 17 | 92 | ○Δ | X | ○Δ |
| Comp. Ex. 3 | 0.35 | 4.8 | 18 | 10 | 1 | 80 | ○ | ○ | ΔX |
| Comp. Ex. 4 | 0.57 | 6.2 | 13 | 6 | 3 | 100 | ○ | ○ | X |
| Comp. Ex. 5 | 0.58 | 6.9 | 41 | 28 | 21 | 100 | ΔX | Δ | ○ |

TABLE 2

| | | Ratio of | Ratio of | Printing Performance | | |
|---|---|---|---|---|---|---|
| | Average Particle Diameter (μm) | Particles whose Particle Diameter ≧ 100 μm (%) | Particles whose Particle Diameter ≧ 500 μm (%) | Ability to Withstand Repeated Printing (%) | Blanket roller dirtying | Spot Dirtying |
| Example 4 | 35 | 5 | 0.2 | 110 | ○ | ○ |
| Example 5 | 20 | 2 | 0 | 100 | ◎ | ○ |
| Example 6 | 7 | 0.8 | 0 | 95 | ◎ | ◎ |
| Comp. Ex. 6 | 80 | 15 | 0.8 | 90 | ΔX | Δ |
| Comp. Ex. 7 | 80 | 20 | 1.5 | 85 | ΔX | X |
| Comp. Ex. 8 | 3 | 0.5 | 0 | 70 | ◎ | ◎ |

Examples 7 and 8, and Comparative Examples 9 and 10

Mechanical abrading was carried out by using the manufacturing device shown in FIG. 2 under the same conditions as in Example 1. MD-II cyclones (trade name, manufactured by Daiki Engineering Co., Ltd.) were used as the cyclones 54A, 54B. Then, etching treatment, electrolytic surface roughening treatment, and anodizing treatment were carried out under the same conditions as in Example 1, such that the lithographic printing plate supports of Examples 7 and 8 and Comparative Examples 9 and 10 were prepared.

The lithographic printing plate supports was immersed for 14 seconds in a sodium silicate solution whose concentration was 2.5 wt % and whose liquid temperature was 70° C., such that the surface was hydrophilized. Then, a photosensitive resin solution having the following composition was coated onto the lithographic printing plate support by a wire bar method to 2.0 g/m$^2$, and drying was carried out for 1 minute at 100° C. such that a PS plate was prepared.

| | |
|---|---|
| N-(4-hydroxyphenyl)methacrylamide/2-hydroxyethylmethacrylate/acrylonitrile/methylmethacrylate/methacrylic acid (monomer unit mol ratio = 15:10:30:38:7) copolymer (average molecular weight = 60,000). . . | 5.0 g |

-continued

| | |
|---|---|
| hexafluorophosphate of condensation product of 4-diazodiphenylamine and formaldehyde. . . | 0.5 g |
| phosphorous acid. . . | 0.05 g |
| Victoria Pure Blue - BOH (manufactured by Hodogaya Chemical Co., Ltd.). . . | 0.1 g |
| 2-methoxyethanol. . . | 100.0 g |

A film on which a test pattern was printed was superposed on the PS plate, and exposure was carried out by illuminating a 3 kw metal halide lamp for 50 seconds from a distance of 1 mm.

The exposed PS plate was developed by a developing solution having the following composition, such that a printing plate for offset printing was prepared.

| | |
|---|---|
| sodium sulfite. . . | 5.0 g |
| benzyl alcohol. . . | 30.0 g |
| sodium carbonate. . . | 5.0 g |
| sodium isopropylnaphthalene sulfonate. . . | 12.0 g |
| pure water. . . | 1000.0 g |

In the above-described mechanical abrading step, an abrasive slurry, in which the abrasive particles were suspended in water in a ratio of 400 g/liter, was supplied onto the surface to be abraded of the aluminum web W from the first abrasive sprayer 18 and the second abrasive sprayer 20 in a ratio of 200 liters/min for each sprayer. The conveying speed of the aluminum web W was 50 m/min. The average particle diameter of the abrasive particles contained in the abrasive slurry in the slurry circulating tank 50 was measured by using a laser diffraction/scattering type particle size distribution measuring device (trade name: LA-910 manufactured by Horiba Ltd.).

For the average particle diameter of the small diameter particles, the average particle diameter of the particles included in the small diameter slurry discharged to the exterior of the system from the waste water line 60 provided in the manufacturing device, was measured in the same way as the average particle diameter of the abrasive particles contained in the abrasive slurry.

The abrasive slurry was replenished to the slurry circulating tank 50 such that the concentration and the average particle diameter of the abrasive slurry within the slurry circulating tank 50 were constant. On the basis of the replenished amount of the abrasive slurry, evaluation was carried out and four grades of ◎, ○, Δ, and X were given.

The printing plate for offset printing was mounted to an offset printer, and a test pattern was printed by using black ink. The printed sheet surfaces were visually observed, and the ability to withstand repeated printing of the lithographic printing plate was evaluated by the number of printed sheets until defects in the appearance of the printed surface arose. Further, the blanket roller in the offset printer was visually observed, and the size of the blanket roller dirt was evaluated. The ability to withstand repeated printing was evaluated as a percentage of the aforementioned number of printed sheets, with 70,000 printed sheets being 100%. The blanket roller dirt was checked visually, and evaluation was carried out with four grades of ◎, ○, Δ, and X being given.

The results are shown in Table 3.

TABLE 3

| | Abrasive | Small Diameter Particle | | | Evaluation of Printing Performance | |
|---|---|---|---|---|---|---|
| | Average Particle Diameter A (μm) | Average Particle Diameter B (μm) | B/A | Amount of Abrasive Consumed | Ability to Withstand Repeated Printing | Blanket roller dirtying |
| Example 7 | 32 | 10 | 1/3.2 | ○ | 100% | ○ |
| Example 8 | 18 | 4 | 1/4.5 | ○ | 100% | ○ |
| Comp. Ex. 9 | 32 | 19 | 1/1.7 | X | 100% | ○ |
| Comp. Ex. 10 | 32 | 2 | 1/16 | ○ | 83% | X |

As is clear from the above, a lithographic printing plate support which becomes the support of a PS plate having excellent printing performance and ability to withstand repeated printing, and a method of manufacturing which enables production of the lithographic printing plate support with high production stability, and a PS plate having the above merits, are obtained in accordance with the present invention.

What is claimed is:

1. A combination of a lithographic printing plate support and abrasive particles, comprising:

the lithographic printing plate support having a mechanically roughened surface which is roughened by being rubbed by a rotary brush while said abrasive particles are supplied, the abrasive particles having, an average particle diameter of 5 to 70 μm, wherein a contained amount of particles having a particle diameter of 100 μm or more is in a range of 0.8 to 10 wt %, a contained amount of particles having a particle diameter of 500 μm or more is 1 wt %, and a contained amount of $SiO_2$ is 90 wt % or more in the particles.

2. A combination of a lithographic printing plate support and abrasive particles according to claim 1, wherein the mechanically roughened surface of the lithographic printing plate support is anodized and has a photosensitive layer formed thereon.

3. A method of manufacturing a lithographic printing plate support comprising the step of:

subjecting at least one surface of a lithographic printing plate support to a mechanical surface roughening treatment by rubbing by a rotary brush while abrasive particles are supplied, the abrasive particles being such that an average particle diameter thereof is 5 to 70 μm, a contained amount of particles having a particle diameter of 100 μm or more is in a range of 0.8 to 10 wt %, a contained amount of particles having a particle diameter of 500 μm or more is 1 wt %, and a contained amount of $SiO_2$ is 90 wt % or more in the particles.

4. A method of manufacturing a lithographic printing plate support according to claim 3, wherein a diameter of brush bristles of the rotary brush is 0.15 to 1.35 mm, and an embedding density of the brush bristles is 30 to 5000 bristles/$cm^2$.

* * * * *